US005133261A

United States Patent [19]

Kelsey, Jr.

[11] Patent Number: 5,133,261

[45] Date of Patent: * Jul. 28, 1992

[54] DEVEL SMALL ARMS BULLET

[76] Inventor: Charles C. Kelsey, Jr., 1601 Hollyhurst, Ste. 21, Houston, Tex. 77056

[ * ] Notice: The portion of the term of this patent subsequent to May 26, 2009 has been disclaimed.

[21] Appl. No.: 660,411

[22] Filed: Feb. 22, 1991

Related U.S. Application Data

[63] Continuation-in-part of Ser. No. 542,889, Jun. 25, 1990.

[51] Int. Cl.[5] ..... F42B 10/04; F42B 12/00

[52] U.S. Cl. ..... 102/439; 102/448; 102/501; 102/517; 102/522; 244/3.23

[58] Field of Search ..... 102/398, 439, 448, 501, 102/517-523; 244/3.23

[56] References Cited

U.S. PATENT DOCUMENTS

| | | | |
|---|---|---|---|
| 33,863 | 12/1861 | Woodbury | 244/3.23 |
| 534,352 | 2/1895 | Stuart | 244/3.23 |
| 1,794,141 | 2/1931 | Bloch-Jorgensen | 102/521 |
| 3,062,145 | 11/1962 | Morgan et al. | 102/439 |
| 3,572,250 | 3/1971 | Kriesel et al. | 102/398 |
| 4,572,077 | 2/1986 | Antoine et al. | 102/501 |
| 4,829,904 | 5/1989 | Sullivan | 102/439 |

FOREIGN PATENT DOCUMENTS

| | | | |
|---|---|---|---|
| 427713 | 3/1911 | France | 102/501 |
| 24432 | of 1903 | United Kingdom | 244/3.23 |
| 451031 | 7/1936 | United Kingdom | 102/501 |
| 538276 | 7/1941 | United Kingdom | 102/501 |

*Primary Examiner*—Harold J. Tudor

*Attorney, Agent, or Firm*—Pravel, Gambrell, Hewitt, Kimball & Krieger

[57] ABSTRACT

A small arms projectile has a body that includes a larger cylindrical main body section and a smaller generally frusto-conical front body section with a plurality of curved veins or ribs mounted thereon that define the frusto-conical shape of the front body portion as generated during rotation of the projectile. The front body section has an annular concave surface and each of the curved ribs or veins extends between the concave surface and an outermost edge. The projectile can be used with standard pistol and rifle cartridges such as .22, .38, .45, 9 mm and the like. In a second embodiment, a shot shell sabot-projectile assembly that can be used with smooth bore guns as well as with shot guns of various gauges such as .410, .28, .20, .16, .12 and .10 for example.

6 Claims, 2 Drawing Sheets

DEVEL SMALL ARMS BULLET

CROSS REFERENCE TO RELATED APPLICATIONS

This is a continuation-in-part of copending U.S. patent application Ser. No. 07/542,889, filed Jun. 25, 1990 which is incorporated herein by reference.

BACKGROUND OF THE INVENTION

1. Field Of The Invention

The present invention relates to small arms projectiles and more particularly relates to an improved small arms projectile for use in but not limited to semiautomatic pistols, shotguns, revolvers, rifles, carbines, submachine guns as well as light and heavy machine guns. Even more particularly, the present invention relates to an improved small arms projectile that incapacitates more efficiently as compared to existing expanding projectiles and features a conically shaped forward section of the projectile and a cylindrically shaped rear section wherein the projectile carries a plurality of circumferentially spaced curved ribs mounted upon a concave annular surface portion of the forward section of the projectile.

2. General Background

There are various types and calibers of small arms bullets such as .45 caliber, 10 millimeter, .40 caliber and 9 millimeter. Pistol bullets, for example, are available in various forms including ball ammunition using a full metal jacket round nose configuration with a lead core. There is also available a truncated cone full metal jacket pistol bullet with a blunt tip and a lead core. Jacketed hollow point pistol bullets provide a lead core and there are also available and known jacketed soft lead point pistol bullets with a lead core.

The full metal jacket round nose bullets have been in use since the advent of the first semi-automatic pistols in the late 1800's and in the early 1900's. The round nose configuration was derived primarily to facilitate reliable feeding and function in magazine charged semi-automatic pistol. Little if any thought was then given to terminal-ballistic bullet effects.

Truncated cone full metal jacket pistol bullets have a blunt tip. They originated shortly after the full metal jacket round nose bullets around 1906. The German army adopted the nine millimeter luger cartridge with a truncated cone full metal jacket bullet about six years later. The rational for the blunt nose was to deliver more kinetic energy to a target upon impact. The outer corner of the truncated cone bullet tip is radiused for reliable feeding.

Jacketed hollow point pistol bullets were developed after World War II. They were designed with the idea that the hollow cavity within the lead core would upon impact cause the bullet to expand, thereby creating an enlarged wound cavity or channel. Jacketed hollow point bullets have a blunt nose profile similar to full metal jacket truncated cone bullets. The jacket on a hollow point bullet extends around the outer diameter of the tip in a radius to insure reliable feeding.

The jacketed soft lead point pistol bullets are configured the same as full metal jacketed round nose projectiles. The soft lead point is thought to facilitate expansion of the bullet upon impact with a target. However, reliable feeding has been a problem with soft point bullets when used in magazine charged weapons.

Recently, law enforcement officers have adopted semi-automatic pistols with greater fire power in that they carry a magazine holding between eight and seventeen rounds. These semi-automatic pistols are gradually replacing the more traditional six shot revolvers. A U.S. Federal Bureau of Investigation Advisory Committee recently conducted an evaluation of semi-automatic pistols and presented findings relative to the terminal incapacitation effectiveness of nine millimeter and .45 caliber semi-automatic pistol ammunition. In summary, their conclusions found that because of the low velocities at which current pistol projectiles travel, jacketed hollow point bullets cannot be expected to reliably expand over the broad spectrum of law enforcement shooting situations. Further, if hollow point projectiles do expand upon surface impact, they cannot be relied upon to adequately penetrate to reach vital organs.

The established shortcomings of existing commercially available pistol projectiles as regards their ability to effectively incapacitate human targets over the broad spectrum of shooting situations that are frequently encountered by those in the law enforcement and military communities are well documented.

Various projectiles have been patented which disclose projectile constructions such as Kriesel U.S. Pat. No. 3,752,250 , the European patent 346,779 and the Canadian patent 577,406 to Whipple. The Kriesel patent 3,572,250 is directed to a cone for an aeroballistic missile, the main function of which is to prevent undue penetration when a missile enters the earth at a relatively high velocity. The shape of the cone allows easy initial penetration of the missile, but prevents undue penetration and allows the cone to stand erect during use.

Another patent disclosing a projectile with a configuration different than the above discussed commercially available ammunition is the French patent 427,713 .

3. General Discussion Of The Present Invention

The present invention provides an improved small arms projectile which provides a substantial increase in area of sharp edges on the forward section of the projectile using fins with rearwardly tapering leading surfaces to produce more severe cuts and lacerations in a target wound channel thereby causing profuse bleeding.

The present invention causes the bullet to spin upon launch from a smooth bore gun barrel through the use of curved fins at the tip extremity. Projectile stability is achieved because of the spinning effect. The plurality of curved fins produce a more optimal penetration capability of the bullet into barrier and target mediums, causing a decreased tendency of the fins to shear from the bullet frontal extremity due to bullet rotation. The bullet fins can also be curved in a direction which compliments gun barrel rifling and thus offers less atmospheric resistance to the flight of the bullet.

Vertical concave fin surfaces in combination with the curved surfaces separating the fins effect a dramatic increase in the radially directed outward flow of target mass (blood, tissue and bone particles) into the target wound channel as compared to prior art projectiles, thereby enlarging the cuts and lacerations in the wound channel made by the sharp leading edges of the fins, which causes profuse bleeding.

The present invention provides an improved small arms projectile having a main body with a central longitudinal axis which is cylindrical and of a first larger diameter. The projectile body also includes a front body section with a smaller diameter flat front end connected integral with the main body section and having a gradually decreasing diameter between the end connected to the main body section and the flat front end.

The front body section has a concave and circumferentially extending annular surface and a plurality of circumferentially spaced curved ribs or fins which are positioned on the front body section, each extending between the main body section and the flat front end portion. Each of the ribs or fins has outermost edges. Spaced apart concave and convex rib side surfaces define the curvature and thickness of each rib. The curved ribs each extend between the concave annular surface and the outermost edges.

The ribs generate a preferably frustro-conical shape during rotation of the projectile about its central longitudinal axis. The ribs are equally spaced circumferentially about the central longitudinal axis.

Each rib preferably has a plurality of outermost intersecting surfaces including a diagonally extending linear flat surface, and a surface intersecting the diagonal surface which is an extension of the outer surface of the cylindrical main body section. A second flat outermost surface is perpendicular to the central longitudinal axis and communicates with the flat end portion, forming a plane therewith.

The concave annular surface has a curvature that gradually increases in a fore to aft direction, which can be a partial parabolic or elliptic shape.

BRIEF DESCRIPTION OF THE DRAWINGS

For a further understanding of the nature and objects of the present invention, reference should be made to the following detailed description taken in conjunction with the accompanying drawings, in which like parts are given like reference numerals, and wherein.

DETAILED DESCRIPTION OF THE PREFERRED EMBODIMENT

Figure 1:
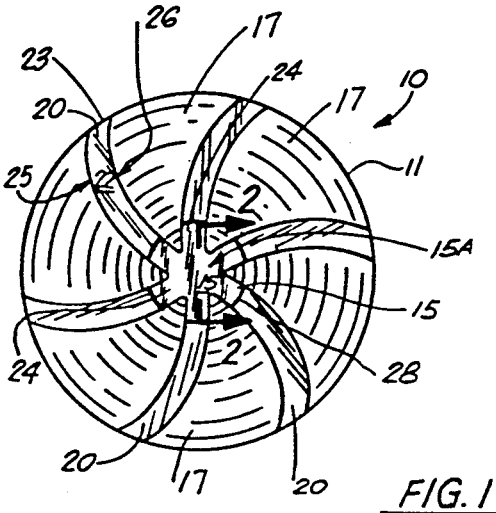
FIG. 1 is a top view of the preferred embodiment of the apparatus of the present invention.
Figure 2:
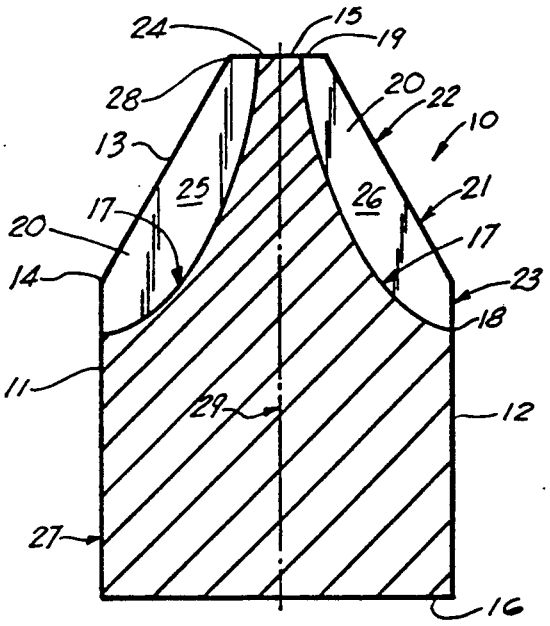
FIG. 2 is a side, sectional view of the preferred embodiment of the apparatus of the present invention taken along lines 2—2 of FIG. 1.
Figure 2A:
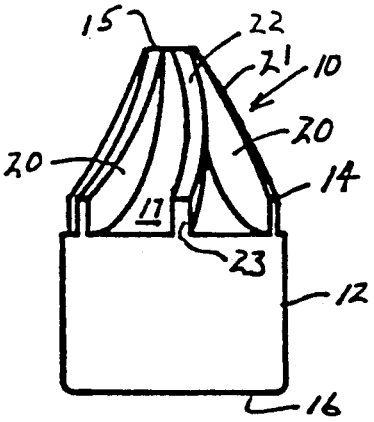
FIG. 2A is a side plan view of the apparatus of FIGS. 1 and 2.
Figure 3:
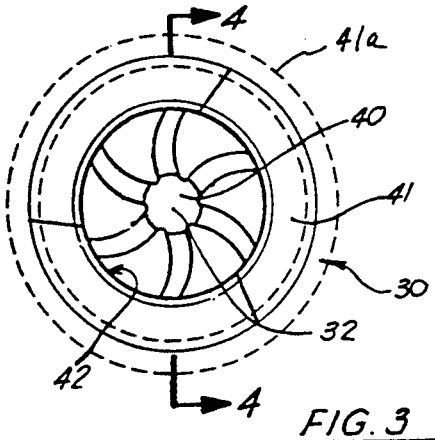
FIG. 3 is a top view of a second embodiment of the apparatus of the present invention.

FIGS. 1-2A illustrate generally the preferred embodiment of the apparatus of the present invention designated generally by the numeral 10. In FIGS. 1 and 2 there can be seen a projectile body 11 that includes a cylindrical section 12 of larger diameter (with outer surface 27) and a front section 13 that generates a frustro-conical shape during rotation of the projectile 10. The front section 13 is integrally formed at connection 14 with the cylindrical body section 12. A flat front end portion 15 defines the forward most end of the projectile 10. The rear 16 of projectile 10 is flat and circular, and abuts a cartridge case which carries powder for propelling the bullet.

The forward end 13 has an annular concave surface 17 beginning at 18 and extending forwardly, terminating at 19. The annular surface 17 preferably has a gradually increasing curvature beginning at the front or forward end 15 of projectile 10 and terminating at the position 18 wherein curvature is greatest.

A plurality of curved ribs 20 (FIGS. 1, 2 and 2A) extend from the curved annular surface 17 and terminate at outermost edge 21. The outer edge 21 which preferably comprises three intersecting surfaces including diagonal surface 22, curved surface 23 which is curved like the outer surface of cylindrical body 12, and flat surface 24 which is perpendicular to axis 29 and communicates with flat forward end 15 at edges 28. In FIG. 1, it can be seen that the flat forward end 15 is in the form of a star shaped member comprising a central portion 15A and the plurality of radially extending flat surfaces 24. As shown in FIGS. 1 and 2A, the curved ribs 20 have parallel sides extending along their entire length.

The surfaces 22 are curved in that each rib 20 provides a convex curved sidewall 25 and a concave curved sidewall 26 which are preferably of substantially equal curvature.

The surface 23 can be flat, or can be an extension of the cylindrical body 23 and thus have the same curvature as the outer surface of cylindrical body 12.

The projectile 10 could be manufactured of lead for example or any other structurally sound material used in the manufacture of small arms projectiles.

Figure 5:
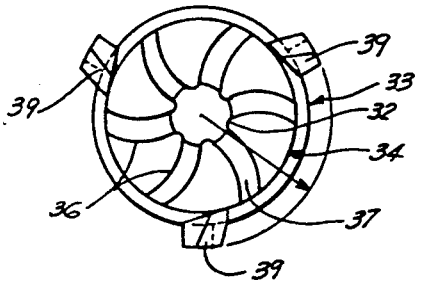
FIG. 5 is a partial, top view of the second embodiment of the apparatus of the present invention.
Figure 4:
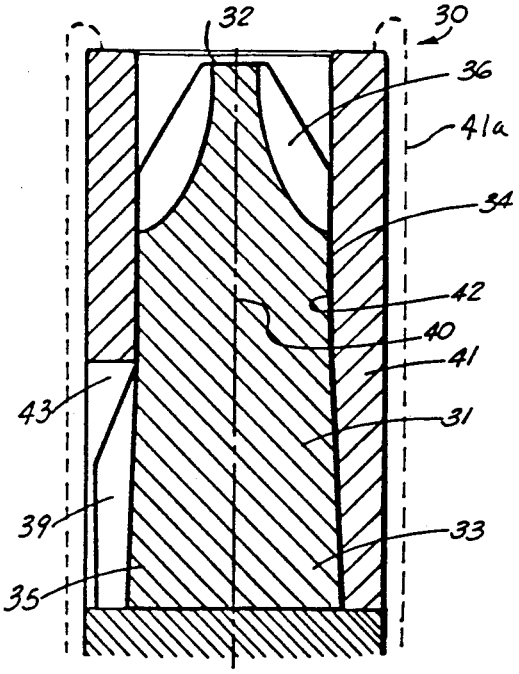
FIG. 4 is a sectional elevational view taken along lines 4—4 of FIG. 3.
Figure 6:
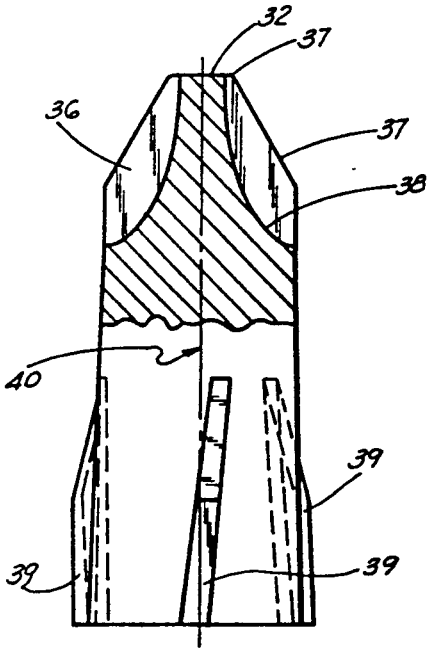
FIG. 6 is a partial sectional elevational view of the second embodiment of the apparatus of the present invention.

FIGS. 3-6 illustrate an alternate embodiment of the apparatus of the present invention designated by the numeral 30. In FIGS. 4-6, assembly 30 includes a three (3) piece sabot 41 and a projectile 31 having a front end 32. The projectile 31 includes a cylindrical body section 33 that can be somewhat tapered providing a smaller diameter front end 34 and a larger diameter rear end 35 to the generally cylindrical section 33. The front end 32 defines the smallest diameter of the projectile 31 as was the case with regard to the embodiment of FIGS. 1 and 2. Similarly, the embodiment of FIGS. 3-6 provides a projectile 31 having a plurality of curved ribs 36 each extending from an annular surface 38 and terminating at an outermost edge 37 as was the case with the embodiment of FIGS. 1-2. As regards the front end 32, the curved ribs 36 and the annular surface 38, the construction of those parts is the same as with regard to the preferred embodiment of FIGS. 1 and 2.

A second plurality of ribs 39 are mounted on a cylindrical section 33, each preferably forming an acute angle with a central longitudinal axis 40 of the projectile 31. The ribs 39 are preferably flat, planer structures as shown in FIGS. 4-6.

The assembly 30 includes sabot 41 for containing the projectile 31. The sabot would be of similar construction to a common shotgun shell sabot as shown by dotted lines 41*a* in FIGS. 3 and 4 of a typical shotgun shell casing. A shot shell sabot-projectile assembly can be used with shotguns of various gauges such as 0.410, 0.28, 0.20, 0.16, 0.12 and 0.10, for example inside surface 42 of sabot 41 conforms to the outer surface of the projectile cylindrical surface 33 as shown in the drawings. A cutout or recess 43 in the sabot 41 is provided for each rib 39 which extends along the rear extremity of the projectile 31.

The following table lists each of the part numbers and part descriptions as used herein:

| PARTS LIST | |
|---|---|
| Part Number | Part Description |
| 10 | projectile |
| 11 | body |
| 12 | cylindrical section |
| 13 | front section |
| 14 | integral connection |
| 15 | front end |
| 16 | rear end |
| 17 | annular surface |
| 18 | beginning of annular surface |
| 19 | end of annular surface |
| 20 | curved rib |
| 21 | outermost edge |
| 22 | diagonal flat surface |
| 23 | curved surface |
| 24 | flat surface |
| 25 | convex curved sidewall |
| 26 | concave curved sidewall |
| 27 | cylindrical body outer surface |
| 28 | edges |
| 29 | central longitudinal axis |
| 30 | assembly |
| 31 | projectile |
| 32 | front end |
| 33 | cylindrical surface section |
| 34 | smaller front end |
| 35 | larger diameter rear end |
| 36 | curved ribs |
| 37 | outermost edge |
| 38 | annular surface |
| 39 | rib |
| 40 | central longitudinal axis |
| 41 | sabot |
| 41a | shot shell casing |
| 42 | inside surface of sabot |
| 43 | cutout of rib |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A small arms cartridge, comprising:

(a) a small arms projectile including;

(1) a substantially cylindrical main body;

(2) a front portion formed as one-piece with the main body and terminating in a flat front end which is smaller than the diameter of the main body;

(3) the front portion formed of a plurality of narrow ribs with parallel sides extending along their entire length, said ribs also extending radially outward and equally spaced around the front portion, the ribs extending from the main body to the flat front end, at least a major portion of the outer surface of the ribs continuously tapering from the outer diameter of the main body to the flat end, the ribs being curved in the same direction so that each rib has a convex curved side and a concave curved side of substantially the same curvature;

(4) cavities formed between the ribs, at least a major portion of which form a continuously curved surface from the outer diameter of the main body inwardly toward the flat front end; and (b) a cartridge case holding the main body.

2. The small arms cartridge of claim 1, wherein the plurality of ribs include six ribs equally spaced around the outer surface of the front portion.

3. The small arms cartridge of claim 1, and further including the ribs extending a short distance along the diameter of the main body and then tapering linearly to the flat end.

4. The small arms cartridge of claim 1, wherein the curved portion of the cavities is in the shape of a parabolic curve.

5. The small arms cartridge of claim 1, wherein the curved portion of the cavities is in the shape of an elliptical curve.

6. The small arms cartridge of claim 1, and further including a shot shell sabot with an open front end for holding the projectile, and means for mounting the projectile in the sabot so that the flat front end of the projectile is pointing toward the open front end of the sabot.

* * * * *